United States Patent [19]

Lebel

[11] Patent Number: 4,932,185

[45] Date of Patent: Jun. 12, 1990

[54] WINDOW CLEANER'S SAFETY LINE ANCHOR

[76] Inventor: Marc Lebel, Pro-Bel Services, 1837 Post Dr., Pickering, Ontario, Canada, L1V 4Y8

[21] Appl. No.: 328,512

[22] Filed: Mar. 24, 1989

[30] Foreign Application Priority Data

Mar. 25, 1988 [CA] Canada ..... 562513

[51] Int. Cl.[5] ..... E04B 1/38

[52] U.S. Cl. ..... 52/704; 52/37

[58] Field of Search ..... 52/37, 704, 699, 701; 403/164; 292/281

[56] References Cited

U.S. PATENT DOCUMENTS

| | | | |
|---|---|---|---|
| 1,250,202 | 12/1917 | Minnis | 52/37 |
| 1,366,920 | 2/1921 | Minnis | 52/37 |
| 1,410,387 | 3/1922 | Dodds . | |
| 1,445,157 | 2/1923 | Noller | 292/281 |
| 1,976,595 | 10/1934 | Asleson et al. | 52/699 |
| 2,275,760 | 3/1942 | Hoffman | 292/281 |
| 3,297,293 | 1/1967 | Andrews et al. | 403/164 |
| 3,404,503 | 10/1968 | Courtois et al. | 52/701 |
| 3,448,958 | 6/1969 | Virkki | 248/237 |
| 4,341,367 | 7/1982 | Wieland | 248/73 |
| 4,408,940 | 10/1983 | Fischer | 411/258 |
| 4,419,785 | 12/1983 | McWhirter | 411/400 |
| 4,431,352 | 2/1984 | Andrews | 403/164 |
| 4,581,863 | 3/1986 | Thaler | 52/126.2 |
| 4,930,341 | 5/1969 | Bertrand et al. | 52/37 |

FOREIGN PATENT DOCUMENTS 809901 3/1969 Canada .

*Primary Examiner*—James L. Ridgill, Jr.
*Attorney, Agent, or Firm*—Ridout & Maybee

[57] ABSTRACT

This invention relates to safety anchors for attachment of safety lines. The prior art anchors have weak resistance to lateral stresses and are susceptible to failure. The invention provides a safety anchor comprising a U-shaped anchor member having a pair of ends, a base for the anchor member, a tensile stud, and a supporting means. The ends of the U-shaped anchor member are securely attached to the base while the base has an aperture through it between the ends of the anchor member. The tensile stud passes through the aperture in the base to secure the base directly to a roof structure. The supporting means securely supports the base above the roof structure.

13 Claims, 4 Drawing Sheets

WINDOW CLEANER'S SAFETY LINE ANCHOR

Figure 1:
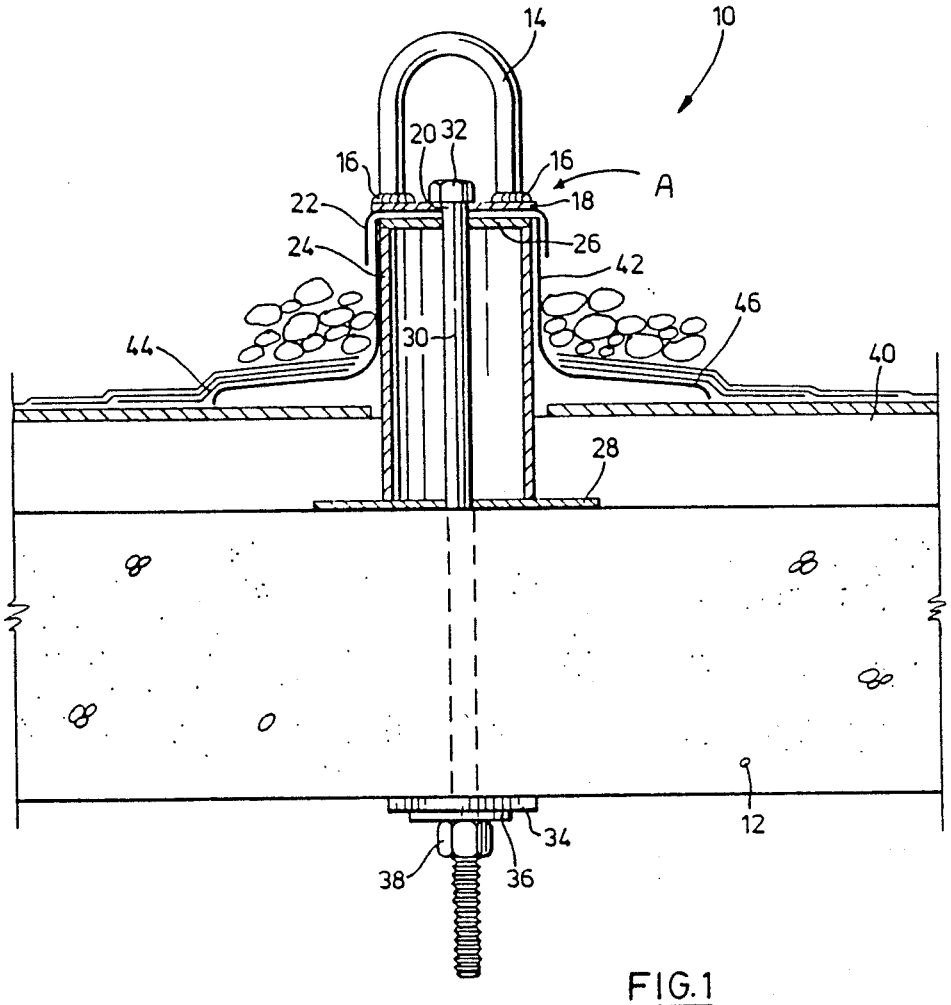

This invention relates to window cleaner's safety line anchors particularly, but not exclusively, for use on highrise buildings and the like, to provide means for the attachment of window cleaner's safety lines.

It is common practice for window cleaners to be provided with an auxiliary safety line for use in emergency situations, such as those which occur when their swing stage fails. However, many highrise buildings are not provided with suitable attachment points or anchors for secure attachment of these auxiliary safety lines. Therefore, these safety lines are often attached to any convenient member around which a rope can be tied that the worker might find available. Clearly, many of these members are not capable of supporting a worker in the event of the worker falling and when put to the test, give way.

It is also known to provide eyebolt anchors on roofs or walls of highrise buildings for attachment of safety lines. However, although eyebolt anchors have adequate tensile strength, they have relatively poor resistance to lateral or shear forces. Unfortunately, in most cases, when a safety anchor is put to the test, the force applied to it is a lateral or shear force. Therefore, where a severe lateral force is applied to an eyebolt anchor, failure of the anchor can occur.

It is an object of this invention to provide a window cleaner's safety line anchor which has good resistance to lateral or shear forces.

The inventor has found that a U-bolt form of anchor offers surprising greater resistance to lateral and shear forces than the conventional circular eyebolt.

The reasons for the outstandingly greater resistance to lateral and shear forces possessed by the U-bolt are not as yet completely understood, but are believed to be related to the geometry of the U-bolt which provides in effect twin supporting pillars formed by the legs of the U. While U-bolts are of course known for various attachment purposes, the strength characteristics of the U-bolt do not appear to have been investigated in depth in the past and there is no prior proposal of which the inventor is aware for advantageously employing these characteristics in a window cleaner's safety line anchor.

According to one aspect of the invention, there is provided a window cleaner's safety line anchor comprising a U-shaped anchor member, a base for the anchor member, a tensile stud, and a supporting means. The ends of the U-shape are securely attached to the base to resist tensile forces to which the anchor is subjected in use, while the base has an aperture through it between the ends of the anchor member. The tensile stud passes through the aperture in the base to secure the base directly to a roof structure. The supporting means securely supports the base above the roof structure.

In another aspect, the invention provides a window cleaner's safety line anchor for a building structure comprising a U-shaped anchor member, a base for the anchor member, a compression member, and a tensile stud. The ends of the U-shape are securely attached to the base to resist tensile forces to which the anchor is subjected in use, while the base has an aperture through it midway between the ends of the anchor member. The tensile stud passes through the aperture in the base, through a structural element of the building structure, through an aperture in the compression member, to secure the base directly to the building structure.

Figure 1A:
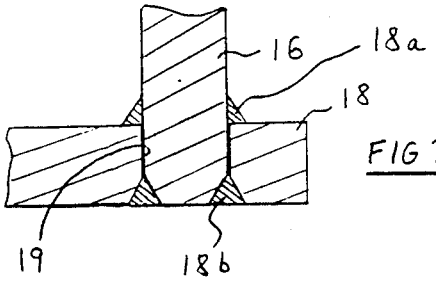
Figure 2:
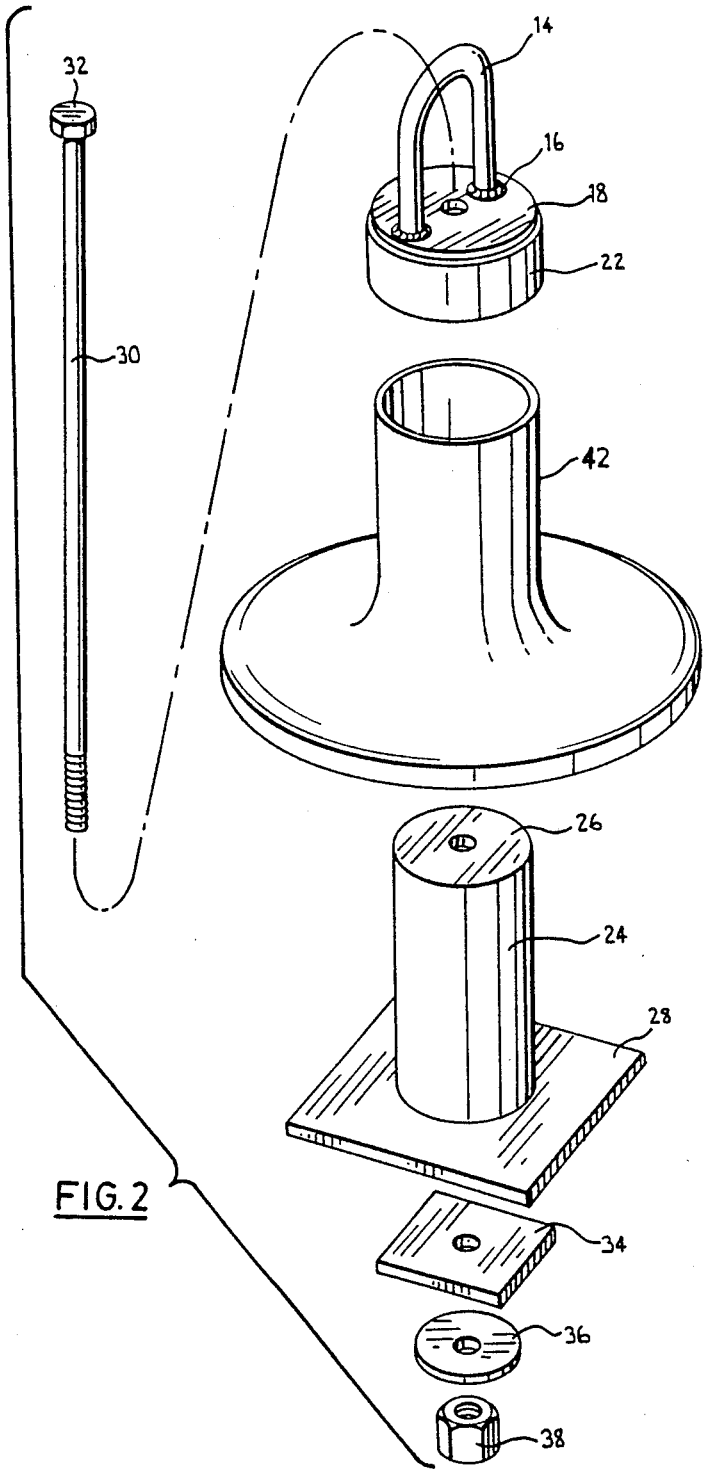
Figure 3:
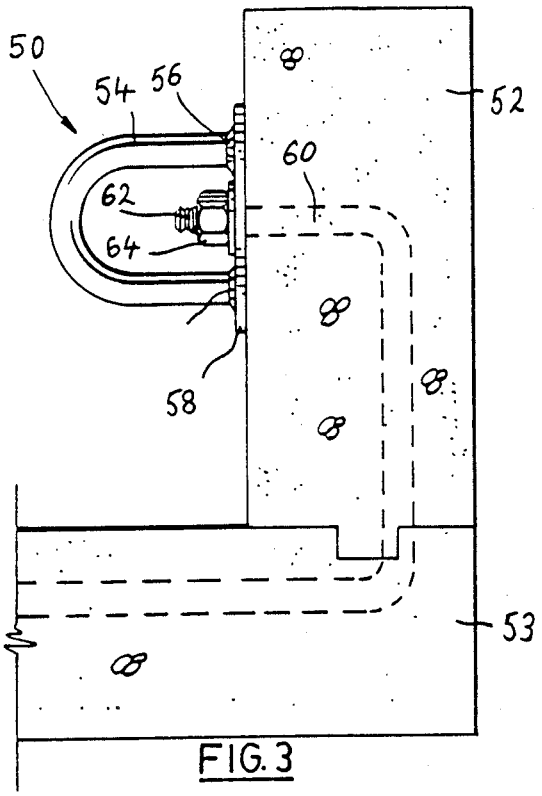
Figure 4:
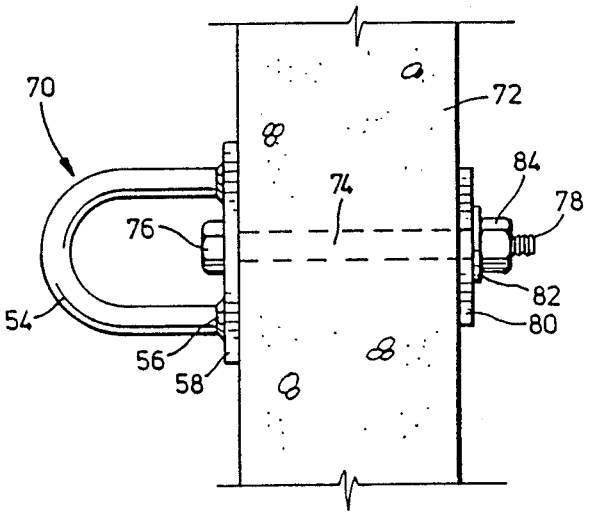
Figure 5:
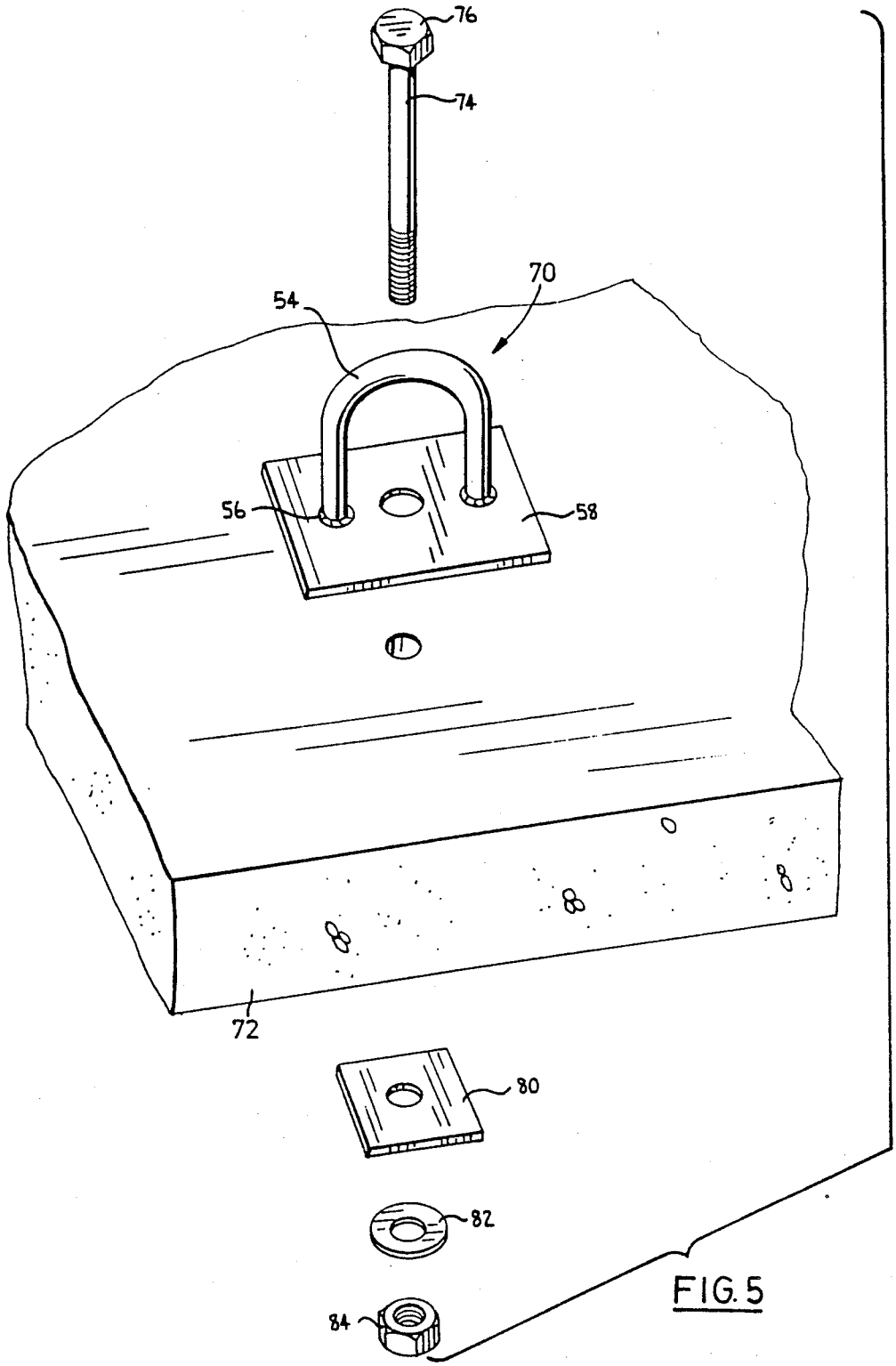

Embodiments of the invention are described, by way of example only, with reference to the drawings in which:

FIG. 1 shows in cross-section a safety line anchor attached to a roof structure;

FIG. 1*a* shows on an enlarged scale a partial cross-sectional view through an edge portion of the anchor indicated by letter A in FIG. 1;

FIG. 2 an exploded perspective view of the anchor of FIG. 1;

FIG. 3 is a side elevational view of a further embodiment of a safety anchor;

FIG. 4 a plan view of a further embodiment of a safety anchor; and,

FIG. 5 an exploded perspective view of the anchor of FIG. 4.

Referring now to FIGS. 1 and 2, a roof anchor, generally indicated by the numeral 10, is supported above a roof structure 12. The roof anchor 10 comprises a U-shaped rod or anchor 14 which has its ends 16 welded to a base plate 18, so that the ends 16 are securely attached to the base to withstand tensile forces to which the anchor will be subjected in use.

In the preferred form, in order to provide the anchor with increased strength properties, the ends 16 of the U-shaped rod are received in respective through-holes 19 in the plate 18, as shown in FIG. 1*a*, and the ends 16 are welded to the plate at weldments 18*a* and 18*b* at the upper and lower sides of the plate 18. More preferably, the lower portion of the end 16 is bevelled, and the lower end of the through hole 19 is flared, e.g. is countersunk, as seen in FIG. 1*a* to provide a downwardly flaring recess occupied by the weldment 18*b*.

In other embodiments, the U-shaped rod portion may be formed in one piece with the base plate 18, for example by casting or by forging.

Desirably, the U-shaped rod 14 resists a tensile force acting a perpendicular to the plate 18 of at least 5 000 lb (22.3 ) without separation from the-plate 18, more preferably at least about 10 000 lb (44.5 ) still more preferably at least about 28 000 lb (124.6 kN), In general, the anchor should be capable of withstanding axially applied loads in excess of the breaking strength or total breaking strengths of the line or lines attached to it.

The base plate 18 has an aperture 20 through it midway between the welded ends 16. A cylindrical, tubular securing member 22, which has its upper end sealed by a plate having a central aperture, is attached to the lower face of the base plate 18. A cylindrical, tubular supporting member 24, which has a plate 26 closing off its upper end and a plate 28 closing off its lower end, supports the base member 18 above a roof structure, e.g. a concrete slab 12, by fitting into the tubular securing member 22. The upper and lower plates 26 and 28 respectively, of the tubular supporting member 24 each have a central aperture. A tensile stud 30, which has a head 32 at its upper end and is threaded at its opposite end, passes through the apertures of each of the base plate 18, the tubular securing member 22, the upper plate 26 and the lower plate 28, to directly secure the base member 18 to the roof structure 12. In the preferred form, the stud 30 is pre-assembled to the plate 18, with the underside of the head 32 welded to the top of the plate 18, to render the assembly watertight. In the embodiment shown, the tensile stud 30 passes completely through the roof structure 12 and is secured to the lower end of the roof structure by passing it through a compression plate 34 and a washer 36 and securing it by means of a nut 38. The plate 18 may be round, as shown, or may be square or rectangular. As will be appreciated, the stud 30 permanently secures the anchor 10 to the building, so that normally the anchor 10 will be removed only for the purposes of maintenance or repair either to the building or roof structure or to the anchor.

The lower plate 28 of the tubular supporting member 24 may project outwardly from the tubular supporting member 24 as shown. In use, the lower plate 28 of the tubular supporting member 24 rests on the upper surface of the roof structure 12. As is customary, a layer of insulation 40 may be applied on the roof structure 12. To ensure that the attachment is waterproof, a flashing member 42, which is generally frusto-conical in shape, may be slipped around the tubular supporting member 24 during assembly of the safety anchor. The upper end of the flashing member 42 fits between the overlapping ends of the tubular supporting member 24 and the tubular securing member 22. The lower end of the flashing member 42 rests on the layer of insulation 40. Further insulation 44 may be applied over the flanges 46 of the flashing member 42 to provide better waterproofing.

Referring to FIG. 3, a safety line anchor, generally indicated by the numeral 50 is shown attached to the inner side of a parapet wall 52 at the edge of a reinforced concrete roof 53. The safety anchor 50 comprising a U-shaped rod or anchor member 54 having its ends 56 attached to a base plate 58. The base plate 58, which, similarly to the plate 18, may be round, square or rectangular, has an aperture mid-way between the ends 56 of the anchor member 54. A tensile stud 60 has a threaded end 62 over which a washer is passed and on which a nut 64 is threaded in order to secure the safety anchor 50 to the wall 52. In this embodiment, the tensile stud extends downwardly into the wall 52, then horizontally and is secured in the adjacent roof 53. The tensile stud 60 is conveniently cast in place when the roof 53 and wall 52 are cast. In this embodiment, the anchor 50 is secured directly adjacent a structural element of the building structure, and is not spaced from it as in the embodiment of FIGS. 1, 1*a* and 2. Clearly, the safety anchor 50 may also be attached to a horizontal structure such as, for example, a reinforced concrete roof deck, with the stud 60, or a portion thereof, extending into the roof structure.

In the further embodiments illustrated in FIGS. 4 and 5, respectively, a safety line anchor, generally indicated by the numeral 70, is attached directly adjacent a reinforced concrete structural element 72 which may be a vertical wall in FIG. 4, for example a parapet wall, or other wall adjacent the side or the middle of a building roof. In FIG. 5, the element 72 is a horizontal reinforced concrete roof deck. The safety line anchor 70 is essentially identical to the roof anchor 50 apart from the tensile stud 74 which extends directly through the wall structure 72. The tensile stud 74 has a head 76 at its anchor end and is threaded at its opposite end 78. In use, the tensile stud is passed through the aperture in the base plate 58 and through the element 72 and is secured in place by passing it through a compression member 80 and a washer 82 and threading a nut 84 on it. The anchor of this embodiment may be used in areas not requiring waterproofing.

In all the embodiments, the U-shaped anchor member and the base plate are preferably manufactured from stainless steel. In general, in modern highrise buildings, the building structures are reinforced concrete but the anchors may be attached to any suitable building structure capable of withstanding the loads to which it may be subjected without deformation, for example wooden beams and the like. Also, the safety line anchor may be attached to a support apparatus as described in Canadian Pat. No. 1,187,853. The tensile studs are preferably stainless or galvanized steel.

The safety line anchors, with their U-shaped attachment anchorages, show surprising resistance to lateral and shear stresses, far more than shown by conventional eyebolts. The following example is given to illustrate this.

The following safety anchors were used in the tests:

Anchor A a standard eyebolt anchor.

A ¾" (19 mm) diameter stainless steel round bar was formed into an eyebolt anchor having a 2¾" (70 mm) inside diameter eyelet with the end of the eyelet welded to the start. The minimum yield stress of the eyelet was specified as 50 000 p.s.i. (344.8 MPa). A 4"×4"×¼" (101.6 mm ×101.6 mm ×6.4 mm) stainless steel base plate surrounded the stud of the anchor and the adjacent part of the eyelet and was welded thereto.

Anchor B a reinforced eyebolt anchor.

As with anchor A but having two reinforcing gussets welded between the base plate and eyelet.

Anchor C U-bolt anchor according to the invention.

A ¾" (19 mm) diameter stainless steel round bar was formed into a 2¾" (70 mm) inside diameter U-bolt of height 3¾" (97 mm) from the plate to the top of the U by welding its ends to a 6"×4"×5/16" (152.4 mm ×101.6 mm ×7.94 mm) stainless steel plate as shown in FIGS. 1 and 1*a*. The yield stress of the U-bolt was specified as 50 000 psi (344.8 MPa). A ¾" (19 mm) diameter stainless steel or galvanised steel bolt, of grade S.A.E. N°5, was passed through an aperture in the base plate mid-way between the ends of the U. bar.

All the tests were carried out in a 400 000 lb (1779 kN) Satec (Trade Mark) tensile/compression test machine. A ram speed of 0.5 inches/minute (12.7 mm/minute)was used for lateral loading tests and 0.2 inches/minute (5.1 mm/minute) was used for axial loading tests.

Test 1 Anchor C was subjected to axial, tensile loading.

Test 2 Anchor A was subjected to axial, tensile loading.

Test 3 Anchor A was subjected to lateral loading perpendicular to the plane of the eyelet.

Test 4 Anchor C was subjected to lateral loading in the plane of the U-bolt.

Test 5 Anchor A was subjected to lateral loading in the plane of the eyelet in a direction running from the eyelet weld to the other side of the eyelet.

Test 6 Anchor A was subjected to lateral loading in the plane of the eyelet in a direction running from the unwelded side of the eyelet to the welded side.

Test 7 Anchor B was subjected to lateral loading in the plane of the eyelet.

Test 8 Anchor B was subjected to lateral loading perpendicular to the plane of the eyelet.

Test 9 Anchor C was subjected to lateral loading perpendicular to the plane of the U-bolt.

The results of the tests are summarized in Table 1.

TABLE I

RESULTS OF LOADING TESTS ON SAFETY LINE ANCHORS

| Test No. | Anchor Type | Load at Initial Bending/lb (kN) | Load at Failure/lb (kN) | Comments |
|---|---|---|---|---|
| 1 | C | 11 500 (51.2) | 28 460 (126.6) | Welds broke and base plate bent. |
| 2 | A | 17 500 (77.9) | 35 200 (156.6) | Threaded rod failed. |
| 3 | A | 3 800 (16.9) | 6 530 (29.1) | Weld cracked. |
| 4 | C | 18 690 (83.1) | — | Bent only |
| 5 | A | 8 000 (35.6) | 16 440 (73.1) | Failed at weld under plate. |
| 6 | A | 7 500 (33.4) | 11 410 (50.8) | Weld broke. |
| 7 | B | 13 000 | 20 170 (89.7) | Weld at bottom of base plate broke. |
| 8 | B | — | 8 000 (35.6) | Weld on top side of plate broke. |
| 9 | C | — | 40 000 (177.9) | Weld cracked. |

In test 4, the plunger applying the force slipped off the side of the U-bolt as it bent in its own plane, and the testing of the anchor could not be continued. The strength at failure would of course be considerably higher than the strength at initial bending and would be expected to be higher than the strength at failure obtained in test 9. .

The tensile strength of U-bolt anchor C was 126.6 kN which, although less than the tensile strength of the eyebolt anchor A, is sufficient to support a worker.

The difference between the results of tests 3 and 9 is highly dramatic. The result obtained in test 3 provides barely adequate strength to safely hold a falling worker. The high shear strength obtained in test 9 is unexpectedly good.

I claim:

1. In combination, a window cleaner's safety line anchor secured to the exterior of a roof structure, comprising:

a U-shaped anchor member having a smoothly arcuate inner side;

a base for the anchor member, with the U-shaped member upstanding from the base and the ends of the U-shaped member fixed to the base to resist tensile forces to which the anchor is subjected in use in arresting the fall of a window cleaner, and the base having an aperture through it between the ends of the U-shaped member;

a tensile stud passing through the aperture in the base into the roof structure and securing the base to the roof structure; and a supporting means spacing the base above the roof structure.

2. A combination according to claim 1 in which the tubular supporting member is a cylindrical member.

3. A combination according to claim 1 in which the tensile stud extends through the roof structure.

4. A combination according to claim 1 further comprising a frusto-conical flashing member, the flashing member surrounding the supporting means and engaging the operatively lower side of the base.

5. A combination according to claim 1 in which the supporting means comprises a tubular supporting member having a plate closing its operatively upper end, the plate having a central aperture through which the tensile stud passes.

6. A combination according to claim 5 in which the tubular member has a plate closing its operatively lower end, the plate having a central aperture through which the tensile stud passes.

7. A combination according to claim 5 in which the base has a tubular securing member attached to its operatively lower side, the tubular securing member fitting over the operatively upper end of the tubular supporting member.

8. A combination according to claim 7 further comprising a frusto-conical flashing member, the flashing member surrounding the tubular supporting member and fitting between the tubular supporting member and the tubular securing member.

9. In combination, a window cleaner's safety line anchor secured to the exterior of a structural element adjacent the roof of a building structure, in which the safety anchor comprises:

a U-shaped anchor member having a smoothly arcuate inner side;

a base for the anchor member, with the U-shaped member upstanding from the base and the ends of the U-shaped member fixed to the base to resist tensile forces to which the anchor is subjected in use in arresting the fall of a window cleaner, and the base having an aperture through it between the ends of the U-shaped member;

a compression member having an aperture through it; and a tensile stud passing through the aperture in the base, through the structural element and through the aperture in the compression member and securing the anchor to the building structure.

10. In combination, a window cleaner's safety line anchor secured to the exterior of a cast structural element adjacent the roof of a building structure, comprising:

a U-shaped anchor member having a smoothly arcuate inner side;

a base for the anchor member, with the U-shaped member upstanding from the base and the ends of the U-shaped member fixed to the base to resist tensile forces to which the anchor is subjected in use in arresting the fall of a window cleaner and the base having an aperture through it between the ends of the U-shaped member;

a tensile stud having a bend in it along its length, and passing through the aperture in the base and into the structural element, with the bend of the stud cast in the structural element, and securing the anchor to the building structure.

11. In combination, a window cleaner's safety line anchor secured to the exterior of a building structure adjacent its roof, said anchor comprising a U-shaped anchor member having a smoothly arcuate inner side fixed to a base to resist tensile forces to which the anchor is subjected in use in arresting the fall of a window cleaner, the U-shaped member upstanding from the base and the base having an aperture through it between the ends of the U-shaped member, and a tensile stud passing through the aperture in the base and into the building structure and securing the anchor to the building structure.

12. The combination as claimed in claim 11 wherein the U-shaped member resists a tensile force acting axially perpendicular to the base of at least about 5000 lb. (22.3 kN) without separation from the base.

13. The combination as claimed in claim 12 wherein the U-shaped member resists a tensile force acting axially perpendicular to the base of at least about 28000 lb. (123.6 kN) without separation from the base.

* * * * *